United States Patent [19]

Bowling et al.

[11] 4,382,410

[45] May 10, 1983

[54] EXPLOSIVE BLASTING METHOD AND MEANS

[76] Inventors: David S. Bowling, Rte. 7, Box 145, Joplin, Mo. 64801; Roy N. Moore, 14811 Kimberly, Houston, Tex. 77079

[21] Appl. No.: 218,489

[22] Filed: Dec. 22, 1980

[51] Int. Cl.[3] ..... F42B 1/02

[52] U.S. Cl. ..... 102/310; 102/312; 102/313; 102/320; 102/321

[58] Field of Search ..... 102/310, 312, 313, 320, 102/321

[56] References Cited

U.S. PATENT DOCUMENTS

| | | | |
|---|---|---|---|
| 2,903,969 | 9/1959 | Kolbe | 102/313 |
| 3,687,075 | 8/1972 | Fritz | 102/312 |
| 3,780,654 | 12/1973 | Shimizu et al. | 102/312 |
| 3,952,655 | 4/1976 | Kusakabe et al. | 102/313 |
| 4,074,629 | 2/1978 | Colgate | 102/313 |
| 4,175,490 | 11/1979 | Britton et al. | 102/312 |
| 4,191,265 | 3/1980 | Bosse-Platiere | 102/310 X |
| 4,248,303 | 2/1981 | Charpentier | 102/313 X |

*Primary Examiner*—Peter A. Nelson

*Attorney, Agent, or Firm*—Head, Johnson & Stevenson

[57] ABSTRACT

An explosive blasting method and apparatus for producing rock fragmentation and substantially reducing the amplitude of seismic effects (ground vibration) in the vicinity of the blast. An embodiment of the invention utilizes an air gap method and apparatus for superheating the air surrounding the charge in a borehole thereby significantly raising the pressure therein coupled with the use of multiple detonation points along the borehole for the reduction of burn time thereby substantially reducing the quantity of explosives used along with a marked reduction of seismic shock, sound and dust effects to the surrounding area.

12 Claims, 16 Drawing Figures

EXPLOSIVE BLASTING METHOD AND MEANS

BACKGROUND OF THE INVENTION

1. Field of the Invention

The present invention relates to explosive blasting techniques and more particularly, but not by way of limitation, to the use of multiple detonation points in a long chain of explosives to reduce burn time and the use of an air gap method and apparatus to reduce the quantity of explosive materials.

2. History of the Prior Art

In the practice of standard blasting methods, elongated boreholes are drilled into a rock formation which is to be removed. The borehole is then completely filled with explosives including solid, liquid or gelatin chemical compounds, which upon detonation, are converted to intensely hot gaseous compounds that, because of confinement within the borehole, exert tremendous destructive forces against the confining rock which typically yields to these forces and is reduced to a rubble which can be further processed by mechanical equipment.

An example of a widely used chemical mixture is ammonium nitrate mixed with a carbonaceous material such as diesel fuel. This mixture, when rapidly brought to a critical temperature and pressure by the detonation of a small primer charge, explodes to form a gaseous mixture of nitrogen, carbon dioxide and water vapor expressed by the equation, $$3NH_4NO_3+CH_2 \rightarrow CO_2+3N_2+7H_2O.$$

The use of this or any other explosive compound or mixture entails replacing the air in a borehole as the hole is partially or entirely filled with the solid, liquid or gelatin compound. The explosive upon detonation is essentially converted to gaseous products similar to the air which has been replaced.

A chronic problem associated with blasting for the purpose of fragmenting rocks is the creation of seismic disturbance of the surrounding area which occasionally results in structural damage to buildings, roadways and even mining equipment at or near the site of the blast. The creation of dust fog, flying projectiles and the shattering effect of high amplitude sound waves have always plagued blasting operations in mining and construction projects.

The seismic shock problems are greater when the blast is large and the explosive charge may become quite large when utilizing boreholes of considerable length. The utilization of long boreholes and hence, large charges of explosives is often dictated by production schedules and hence, the safety of such operations is sometimes compromised for economic expediency.

Although technological advancement has provided more stable and effective explosive chemicals, the advance in blasting techniques has been slow and tedious and the foregoing problems have, for the most part, been left unsolved.

SUMMARY OF THE INVENTION

The present invention provides a blasting method and means for substantially overcoming the problems of unwanted seismic and other peripheral effects while simultaneously permitting a marked reduction in explosive materials to perform effective rock fragmentation.

The inventor has discovered that while unwanted seismic vibration, sound and dust are generally proportional to the amount of explosives in a given charge, it is more dependent on the charge configuration, particularly the length which is directly related to burn time. Hence, by drastically reducing burn time during the explosive process, effective rock fragmentation in the vicinity of the borehole was accomplished and seismic vibration was greatly reduced. Further, harmful sound amplitude was also reduced along with the dust fog and fly rock typically associated with standard blasting techniques.

The shortened burn time was accomplished by establishing multiple detonation points along the entire explosive column in the borehole.

Although Applicant believes that any decrease in burn time, such as to 0.001 seconds, represents an improvement over standard techniques, Applicant has found that by positioning the detonators along the explosive column to assure a burn time of less than 0.0005 seconds, rock fragmentation was complete and the unwanted effects of seismic vibration and dust was significantly reduced. The sound amplitude and duration were also reduced.

Further, in order to achieve such short burn time, the detonators were connected in a parallel circuit with very short lead wires and sufficient electrical power was used to insure substantially simultaneous detonation through the use of said parallel circuit.

Although the reduced burn time is capable of providing the expected results when used in an ordinary explosive column where the borehole is completely filled, the mechanics of placing the detonators becomes extremely difficult and time consuming.

However, Applicant has overcome this difficulty with an air-gap blasting technique. The air-gap technique makes use of the principle that molecules of air, when completely confined in a chamber, superheated and supplemented with additional molecules of a gas will become super active exerting extremely high pressures against the walls of the chamber or borehole.

Applicant, instead of forcing all of the air out of the borehole by completely filling the borehole with explosives, loads only the center portion of the borehole with a column of explosives leaving a cylindrical air gap between the explosive column and the wall of the borehole. This air gap will typically have an annular cross-sectional shape.

The central column is equipped with multiple detonators as set forth above and is centrally located within the borehole with stand-off fins. The column of explosives is made up of a plurality of elongated segments of sticks having mechanical couplers to facilitate making up the electrical parallel circuits for the detonators. This permits the column to be easily assembled as it is being loaded into the borehole.

The elongated annular air gap has been found to require a sufficient size relative to the diameter of the explosives used. Tests utilizing an existing explosive column indicate that the ratio of the diameter of the borehole to the diameter of the explosive column is most effective when the ratio is a minimum of 2.5. Successful tests have been conducted utilizing explosives in 2.25 inch diameters in boreholes having diameters of 9 inches and 10 ⅝ inches, which represents a considerably larger ratio.

However, it is believed that a ratio of at least 2.5 is necessary to provide a sufficient quantity of air to sustain an intense shock wave for the very short distance necessary for the heat release and additional gaseous products of the detonation to play a role in the pressure build-up.

In another instance, wherein the ratio of the borehole diameter to the charge diameter was less than 2.5, this shot resulted in poor fragmentation as compared to the cases wherein the ratio was maintained at greater than 2.5.

If there is not sufficient air to form this bridge, there is serious loss of heat by transfer to the rock. Further, it was found to be important to take care in centrally locating the explosive column within the borehole. At least one test was conducted wherein the charge was allowed to sag and touch the borehole wall which resulted in serious failure. It is believed that such failure was due to significant heat transfer to the rock without sufficient backing from the explosive load to perform the necessary work.

When the central column of explosives is detonated, the pressure within the borehole is adiabatacally increased by superheating the air within the air gap.

The air bridge technique appears to work in two stages. First, there is a rapid heat release due to the explosion which imparts a shock to the air surrounding the charge. Then the explosive products in the gaseous form are added to the borehole chamber which, in effect, increases the quantity of hot gases without an increase in volume thereby increasing the pressure to complete the rock fragmentation.

It is believed that the addition of organic materials in the air space such as propane, butane or even frothed coal emulsion, could materially add to the energy release of the explosion.

However, it is believed that the air bridge or gap technique requires the rapid burn time provided by the multiple detonation process hereinbefore set forth in order to achieve the necessary rapid pressure increases to complete rock fragmentation.

DESCRIPTION OF THE DRAWINGS

Other and further advantageous features of the present invention will hereinafter more fully appear in connection with a detailed description of the drawings in which.

DESCRIPTION OF THE PREFERRED EMBODIMENTS

Figure 1:
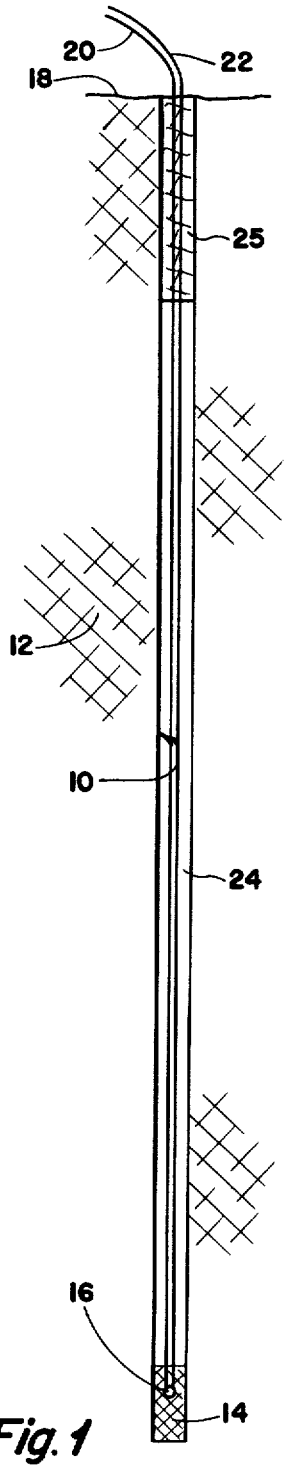
Fig. 1 (PRIOR ART)
FIG. 1 is a sectional side view of a borehole conventionally loaded with explosives.

Referring to the drawings in detail, reference character 10 generally indicates an elongated borehole drilled into a rock structure 12 which is to be fragmented by an explosive detonation.

Using conventional explosive techniques, the borehole 10 is first loaded with a toe load of explosives 14 and provided with a detonator 16 which is connected to a surface 18 of the formation by means of lead wires 20 and 22 which are strung through the borehole 10. The hole 10 is then filled with explosives 24 either in bulk form or by a plurality of elongated sticks and the outer end of the borehole is then filled with a packing material indicated by reference character 25. Detonation of the column of explosives 24 is then accomplished by transmitting an electrical impulse along the wires 20 and 22 to ignite the detonator 16 thereby causing the explosive column to rapidly detonate. The sharply increased pressure resulting from this detonation intensely loads the rock causing breakage.

Figure 2:
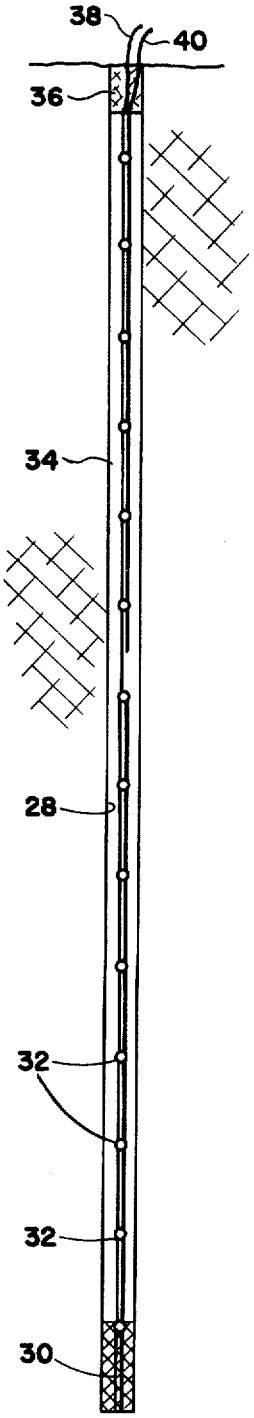
FIG. 2 is a sectional side view of a borehole having multiple detonation points in accordance with the present invention.

Referring now to FIG. 2, reference character 28 indicates a similar borehole which is again loaded with a toe load 30 of explosives. However, in the present case a plurality of spaced detonators 32 is provided throughout the borehole and the borehole is again filled with explosives 34, the outer end of the borehole being packed with a suitable packing material 36. In the present case, the detonators 32 are connected in a parallel circuit by means of a pair of wires 38 and 40. The spacing of the detonators is dependent on the rate of propagation of burn of the explosive material so that the entire explosive burn time is as short as possible, typically 0.0005 seconds or less in order to effect sufficient rock fragmentation which minimizes unwanted side effects of strong seismic vibration, sound and dust.

Figure 3:
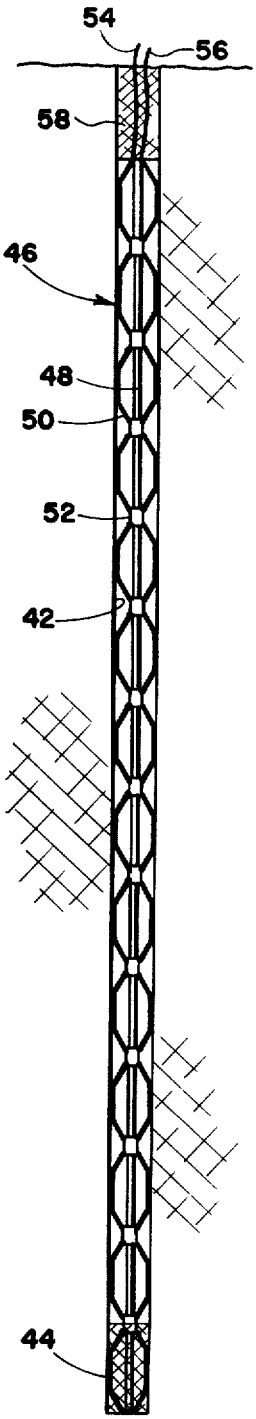
FIG. 3 is a sectional side view of a borehole depicting an air bridge, multiple detonator loading of explosives taught by the present invention.

Referring now to FIG. 3, reference character 42 indicates an elongated borehole, again the lower end of which is provided with a toe load of explosives 44. The borehole 42 in then filled with an explosive column 48 which comprises a plurality of explosive segments 46 having a plurality of stand-off fins 50 in order to center the explosive column 48 within the borehole. Each of the explosive segments are provided with couplers 52 in order to connect the segments in tandem fashion as shown and each of the couplers 52 are provided with a detonator, the detonators to be connected in parallel by means of wires 54 and 56 with short lead lines to the detonators as will be hereinafter set forth. The outer end of the borehole 42 is then provided with a suitable packing material 58.

Referring now to FIGS. 4, 4A, 5 and 6, reference character 46A depicts one embodiment of the plurality of explosive segment to be loaded into a typical borehole 42 for rock fragmentation therearound.

The explosive segment 46A generally comprises a pair of oppositely disposed sleeve segments or housings 60 and 62. The segment 60 is open at the inner end thereof, the outer end being provided with a smaller opening 64 having a threaded boss 66 at the outer end thereof. The boss 66 then is threadedly secured to a cap member comprising a threaded sleeve portion 68 and flange plate 70 secured to the outer end thereof and made as an integral part thereof. The flange member 70 has a central aperture 72 for permitting lead wires 74 and 76 to extend therethrough.

Three stand-off fins 78, 80 and 82 are radially spaced about and secured to the sleeve segment 60 so that the outer portion thereof is in contact with the walls of the borehole 42. The inner ends of the stand-off fins 78, 80 and 82 are provided with slip couplings 84, 86 and 88, respectively (not shown), for a purpose that will be hereinafter set forth. The sleeve segment 62 is open at the inwardly facing end, the outer end thereof being provided with a boss member 90 which is in turn provided with an opening having internal threads at 92 for receiving a second sleeve member similar to 60 hereinbefore described. Three radially spaced stand-off fins 94, 96 and 98 (not shown) are secured to the sleeve 62. The inner ends of the stand-off fins 94, 96 and 98 are provided with coupling members 100, 102 and 104 (not shown) for mating with the coupling members 84, 86 and 88, respectively. Secured between and held in place by the sleeve members 60 and 62, is a preformed stick of explosives 106, the outer end of which is provided with a detonator 108 embedded therein. The detonator 108 is provided with a pair of short lead wires 110 and 112 which are electrically connected to the lead wires 74 and 76, respectively. A first connection wire 114 is secured to the lead wire 110 and is passed between the flange member 70 of the top cap 68 and down along the threaded boss 66 through a slot 116 provided therein. The wire is then connected to an arcuate contact plate 118 which is secured to the outer end of the sleeve segment 60.

The wire 114 is then passed along the fin 78 where it is coupled through the fin coupling members 84 and 100. A second wire segment 119 is then connected to the couplings 84 and 100 and passed along the fin member 94 down to and into contact with a substantially identical contact plate 118 provided in the next subsequent segment as shown in FIG. 4 wherein it is again connected to a second detonator 108 in that subsequent explosive segment.

A second pair of wires 120 and 122, in a like manner, connect the lead wire 112 to the next subsequent detonator by means of a similar slot 124 in the threaded boss member 66 and contact plate 126. In the manner hereinbefore set forth, the detonators 108 are all connected in parallel with short lead wires to the common electrical wires 74 and 76 which are then attached to an electrical generation device (not shown).

Figure 6:
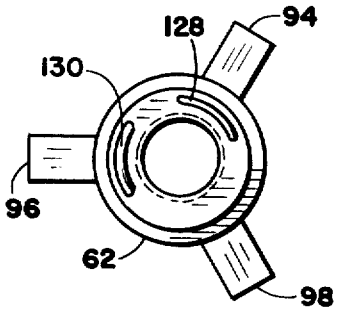
FIG. 6 is an opposite end view of one section of the device of FIG. 4.

Referring now to FIG. 6, it can be seen that the outer end of the threaded boss member 90 is provided with a pair of arcuate contact plates 128 and 130, which when in threaded contact with the next subsequent explosive segment 46A, mate with the contact plates 116 and 126, respectively, in order to complete the circuit.

Figure 4:
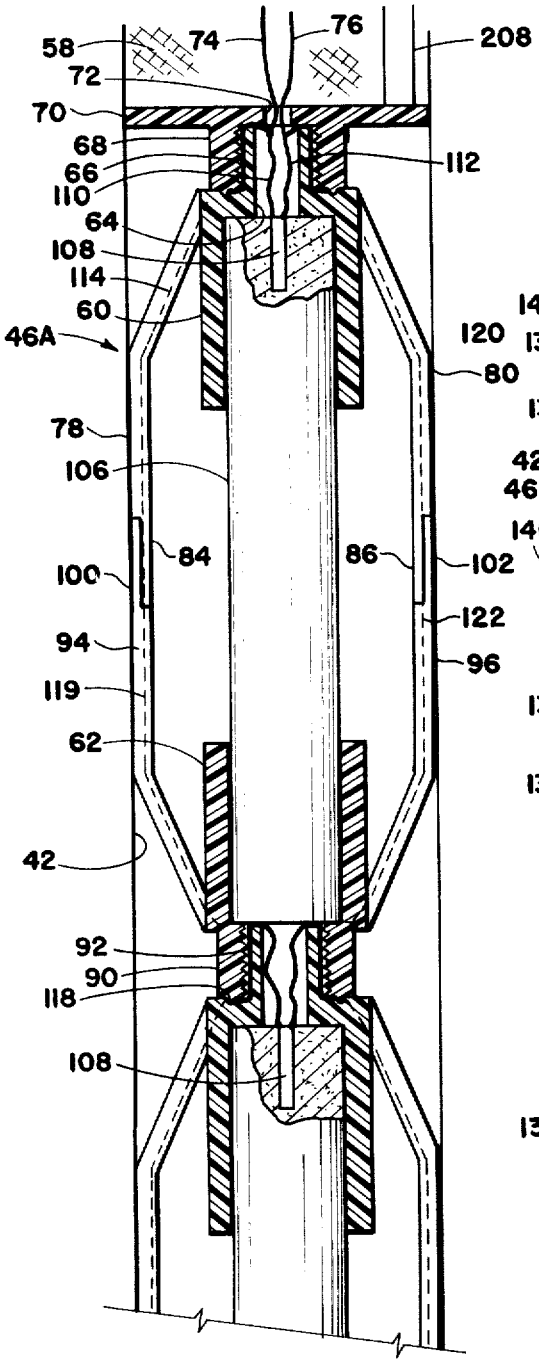
FIGS. 4 and 4A represent sectional side views of two sections of a borehole loaded with explosives under the teachings of the present invention.
Figure 4A:
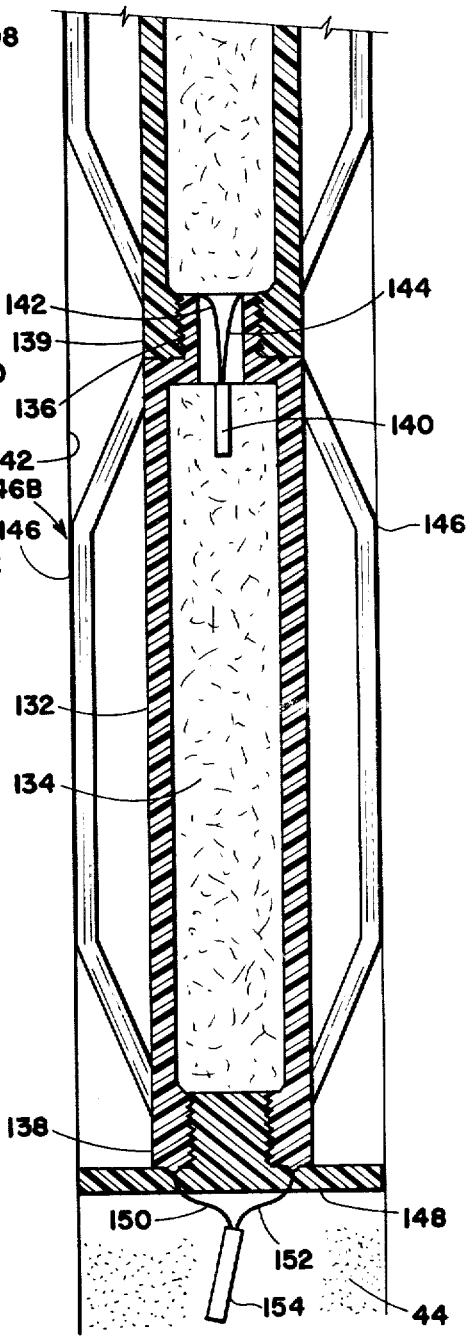

Referring now to FIG. 4A, reference character 46B generally indicates a second embodiment of a plurality of explosive segments similar to the embodiment of 46A. However, the segments 46B comprise an elongated hollow cylindrical member 132 which may be filled with bulk explosives 134. One end of the member 132 is provided with a threaded boss 136 which is constructed substantially identical to the boss 66 hereinbefore described. The other end of the segment 132 is provided with an attachment threaded coupler 138 which is sized to receive the threaded boss member 136 therein. Each segment being filled with bulk explosives is provided with a detonator 140 which is connected by short lead wires 142 and 144. These lead wires 142 and 144 are connected in parallel, again by the use of cooperating contact plates as hereinbefore described. The wires between the contact plates may either be positioned along the standoff fins as hereinbefore set forth or may simply be run down along the outside of the elongated container segment 132. The container 132 then is provided with a plurality of radially spaced stand-off fins 146 as shown in FIG. 4A.

With the use of either the segments 46A or 46B, a bottom flange plate 148 is not necessary, but may be utilized to separate the explosive column from the toe load 44. To ignite the toe load 44 contact leads 150 and 152 are provided through the flange plate 148 to a suitable detonator 154.

Figure 7:
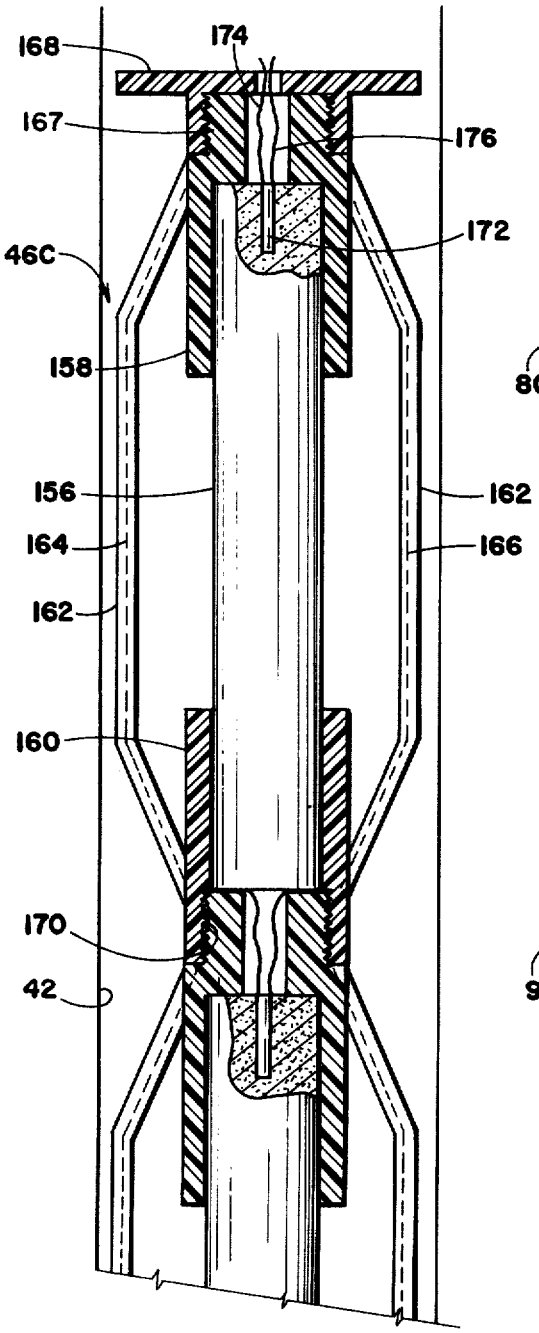
FIG. 7 is an elevational sectional view of a second embodiment of the device of FIG. 4.
Figure 5:
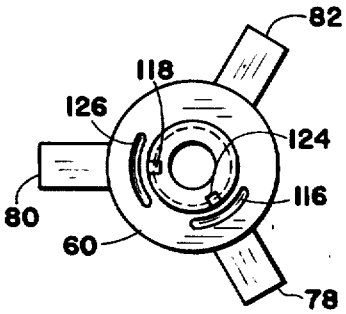
FIG. 5 is one end view of a section of the device of FIG. 4.

Referring now to FIG. 7 of the drawings, reference character 46C generally indicates a third embodiment of a plurality of explosive segments for containing preformed stick explosives 156 therein. The device 46C comprises a pair of oppositely disposed cylindrical sleeve segments 158 and 160 for containing the stick 156 therebetween. The segments 158 and 160 are connected together by a plurality of radially spaced stand-off fins 162 containing connecting wires 164 and 166.

The sleeve segment 58 comprises a threaded boss member 166, the outer explosive segment 46C being provided with a flange plate 168.

The sleeve segment 160 is provided with an enlarged threaded opening 170 forconnection with the next subsequent threaded boss member 167. The enlarged opening 170 is sufficient for inserting the explosive stick 156 therein. Each stick is provided with a suitable detonator 172 having short lead wires 174 and 176, the lead wires being connected in parallel by means of the wires 164 and 166. The electrical connection between the various segments can be accomplished again by the use of arcuate contact plates as hereinbefore described.

Figure 9:
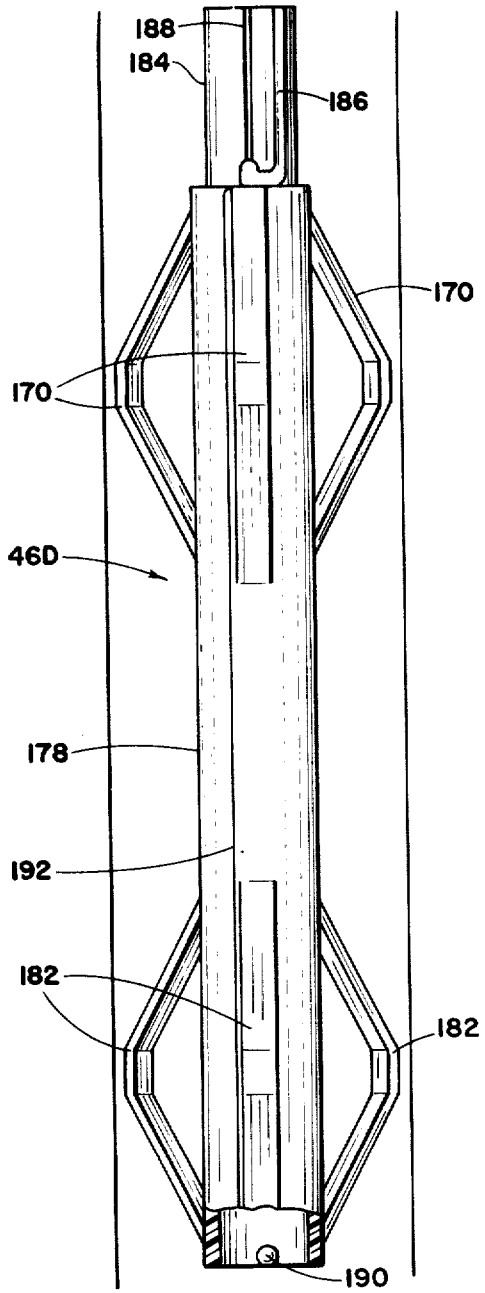
FIG. 9 is an elevational view partially in section of the device of FIG. 8.
Figure 8:
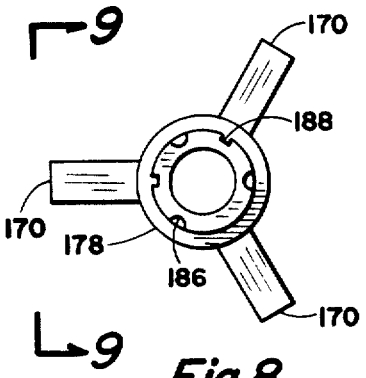
FIG. 8 is an end view of a third embodiment of the device of FIG. 4.
Figure 10:
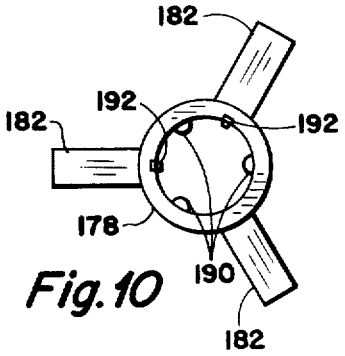
FIG. 10 is an opposite end view of the device of FIGS. 8 and 9.
Figure 11:
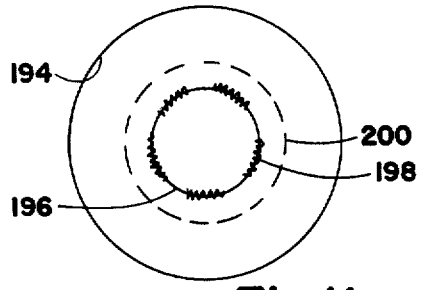
FIGS. 11 through 15 depict an end sectional view of the borehole in five successive stages of an explosion utilizing the teachings of the present invention.

Referring now to FIG. 9 of the drawings, reference character 46D depicts a fourth embodiment of the explosive segment generally having an elongated cylindrical shell or sleeve member 178 for containing explosives. The shell 178 is provided with two sets of standoff fins 180 and 182. One end of the shell 170 is provided with a boss member 184 having a pair of J-shaped connector slots 186 therein. A longitudinal groove 188 is provided along the outer wall of the boss member 184 for passing lead wires (not shown) therethrough. The opposite end of the sleeve member 178 is provided with an opening having a plurality of inwardly extending protrusions 190 for mating with the J-slots 186 of the boss member 184.

The cylindrical shell 178 can be filled with bulk explosives and is provided with a suitable detonator (not shown) in the upper end of the sleeve 178. The bottom portion of the sleeve unit containing the protrusions or nubs 190 when mated to the next subsequent segment 46D will not interfere with the lead wire contained in the longitudinal groove 188 since the wire would be recessed therein. The wire connecting the groove 188 with the next subsequent groove may be affixed to the outer part of the tube as indicated by reference character 192, since it will only be exposed to the air space between the explosive segments 46D and the wall of the borehole.

Mating the segments 46D again connects the electrical circuit by means of contact points 192 located adjacent the protrusion 190.

Figure 12:
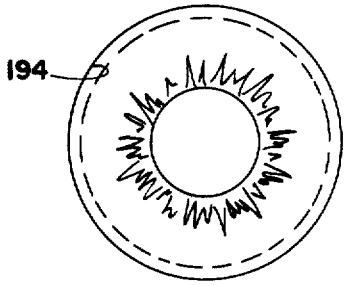
Figure 13:
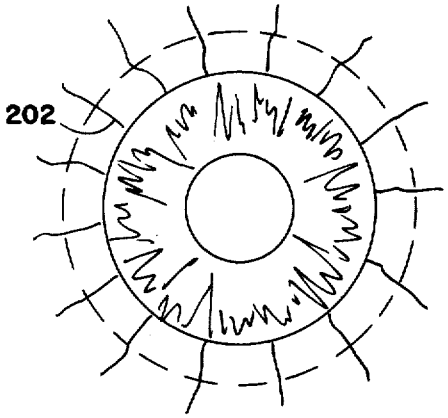
Figure 14:
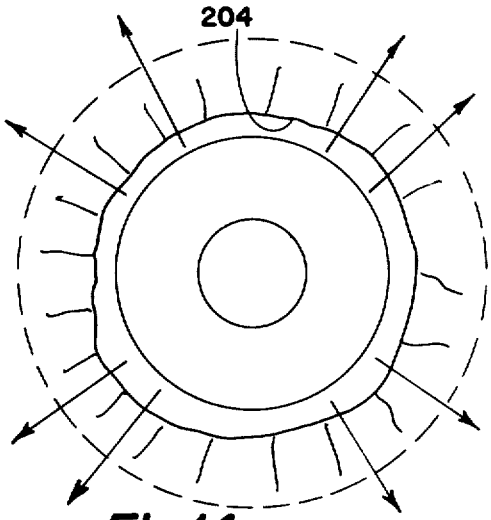
Figure 15:
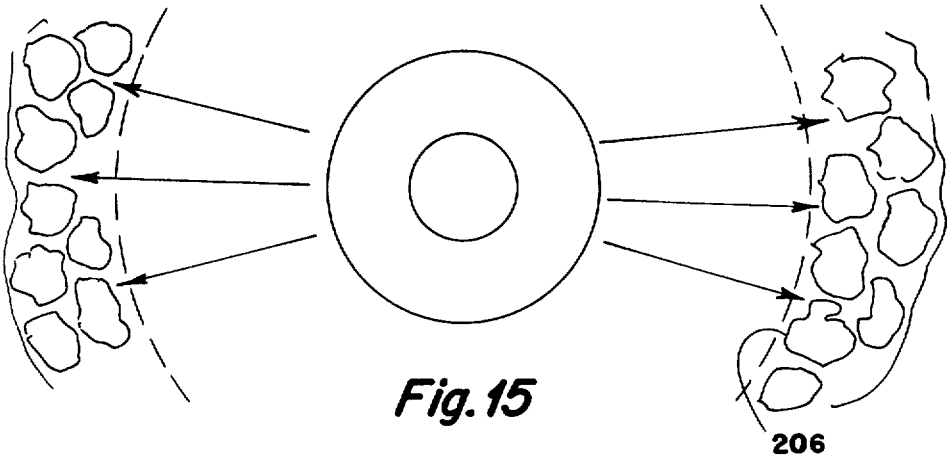

Referring now to FIGS. 11 through 15, FIG. 11 depicts a borehole 194 provided with a centrally disposed column of explosives 196. The broken lines at 198 indicate stage one of the explosion wherein rapid detonation causes heat to be released indicated at 200 in the air gap. FIG. 12 indicates a pressure build-up against the hole wall 194. FIG. 13 indicates radial cracks 202 beginning to open around the hole. FIG. 14 depicts the face of the borehole beginning to swell outward from pressure forces at 204. FIG. 15 depicts rock fragmentation at 206 whereafter the rocks will begin to fall back into the hole that has been widened by the pressure build-up.

It is to be noted at this point that several mechanical apparatuses can be constructed to effect the centering of the column of explosives within the borehole. For example, the borehole does not have to be a vertical borehole in the ground but may be a horizontal borehole in a vein of rock or ore or, in some cases, the hole is drilled vertically upward in order to collapse an ore or rock structure above a mining tunnel.

In the case of a horizontal borehole, oftentimes there is enough space to construct the segments 46 as long segments rather than the short ones depicted herein. However, if the segments are constructed longer, multiple detonation points must be located along the segment in order to insure the rapid burn time hereinbefore set forth.

Each of the embodiments depicted by 46A, 46B, 46C and 46D show a design for various segments that can be preformed and ready for assembly at the site when the charge is being loaded into the borehole. The typical procedure would be to load the toe load of explosives into the borehole. The first explosive segment 46 is then inserted into the borehole and will usually carry the lower or inner detonator 154 for igniting the toe load of explosives.

The second segment is then simply attached to the first segment by one of the coupling means depicted herein whereby when tightened, the electrical contacts are fully made and subsequent segments are added in a like manner until the borehole is filled up to a level wherein packing may be added. The top cap then is secured to the outer explosive segment and the wires are extended outside the borehole. Packing then is provided around the outer end of the borehole wherein the wires may then be attached to a suitable electrical power source (not shown).

As an added feature of the present invention, the top cap such as that depicted by reference character 70 in FIG. 4 may be provided with an air tube 208 wherein after the explosive column is fully inserted along with the packing outside the column, air within the air gap may be withdrawn through the tube 208 and replaced with an organic gaseous material such as propane, butane or frothed coal emulsion in order to enhance the energy release upon detonation.

From the foregoing it is apparent that the present invention provides an effective technique and apparatus for insuring complete rock fragmentation around the immediate vicinity of the borehole without setting up unwanted seismic ground vibration, dust and shock.

Whereas the present invention has been described in particular relation to the drawings attached hereto, other and further modifications apart from those shown or suggested herein may be made within the spirit and scope of the invention.

We claim:

1. A method of fragmenting structure surrounding a borehole comprising the steps of:

placing a plurality of elongated explosive segments in end-to-end relationship within the borehole in which the diameter of the borehole is at least 2.5 times the diameter of the explosive segments;

supporting the explosive segments centrally of the borehole, the annular area between the explosive segments and borehole being filled with a gas;

placing at least one detonation in intimate contact with each said explosive segment;

connecting a short lead wire to each said detonator;

electrically connecting said lead wires in a parallel circuit; and substantially simultaneously detonating said detonators by a single electrical impulse.

2. A method as set forth in claim 1 wherein the spacing of said detonators is dependent upon the longitudinal burn time of the explosive column whereby one-half of the distance between detonators represents a burn time of less than 0.001 seconds.

3. A method as set forth in claim 1 wherein the spacing of said detonators is dependent upon the longitudinal burn time of the explosive column whereby one-half of the distance between detonators represents a burn time of less than 0.0005 seconds.

4. The method of claim 1 in which said annular area is filled with air.

5. A method as set forth in claim 1 wherein each of the elongated explosive segments comprises a centrally located cylindrical housing for supporting an elongated segment of explosives, a plurality of radially spaced stand-off fins for centering said housing within the borehole and couplers connecting the segments in end-to-end fashion while simultaneously mating said lead wires.

6 A method as set forth in claim 1 and including the step of evacuating said annular area and replacing same with an organic material in suspension, said organic material comprising frothed coal emulsion.

7. A method as set forth in claim 1 and including the step of evacuating said annular area and replacing same with an organic gas.

8. A method as set forth in claim 7 wherein the organic gas is of a hydrocarbon including butane and propane.

9. An explosive column as set forth in claim 1 wherein said means to support each said explosive segments centrally of said borehole comprises a centrally located cylindrical housing for supporting an elongated charge of explosives, a plurality of radially spaced stand-off fins for centering said housing within the borehole and wherein said means for connecting said detonators in a parallel circuit comprises coupling means carried by each end of each segment, said coupling means comprising electrical contacts and conductors connected between said electrical contacts.

10. An explosive column as set forth in claim 9 wherein said coupling means comprises threaded couplers.

11. An explosive column as set forth in claim 9 wherein said coupling means comprises cooperating J-slots and nub protrusions.

12. An elongated explosive column for fragmenting rock or ore adjacent the wall of a borehole comprising:

a plurality of elongated explosive segments in end-to-end relationship with the borehole, the diameter of the borehole being at least 2.5 times the diameter of the explosive segments;

means to support said explosive segments centrally of the borehole, the annular area between the explosive segments and borehole being filled with a gas;

at least one detonator positioned in intimate contact with each said explosive segment;

a short lead wire connected to each said detonator;

and means operably connected to said lead wire for connecting said detonators in parallel for simultaneous detonation thereof.

* * * * *